US009704425B2

(12) United States Patent
Zhang et al.

(10) Patent No.: US 9,704,425 B2
(45) Date of Patent: Jul. 11, 2017

(54) GAMMA CURVE ADJUSTMENT METHOD AND GAMMA CURVE ADJUSTMENT APPARATUS

(71) Applicants: BOE TECHNOLOGY GROUP CO., LTD., Beijing (CN); BEIJING BOE DISPLAY TECHNOLOGY CO., LTD., Beijing (CN)

(72) Inventors: Zhi Zhang, Beijing (CN); Lijun Xiao, Beijing (CN); Liyan Wang, Beijing (CN); Weiwei Huo, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 49 days.

(21) Appl. No.: 14/373,982

(22) PCT Filed: Sep. 26, 2013

(86) PCT No.: PCT/CN2013/084301

§ 371 (c)(1),
(2) Date: Jul. 23, 2014

(87) PCT Pub. No.: WO2014/190644

PCT Pub. Date: Dec. 4, 2014

(65) Prior Publication Data

US 2015/0243198 A1 Aug. 27, 2015

(30) Foreign Application Priority Data

May 31, 2013 (CN) ..... 2013 1 0214107

(51) Int. Cl.

| | |
|---|---|
| ***G09G 3/20*** | (2006.01) |
| ***G09G 3/00*** | (2006.01) |
| ***G09G 3/36*** | (2006.01) |

(52) U.S. Cl.

CPC ..... *G09G 3/2003* (2013.01); *G09G 3/006* (2013.01); *G09G 3/20* (2013.01); *G09G 3/3611* (2013.01);

(Continued)

(58) Field of Classification Search

CPC ..... G09G 2310/027; G09G 2320/0276; G09G 2320/0673; G09G 3/006; G09G 3/20; G09G 3/2003; G09G 3/3611

(Continued)

(56) References Cited

U.S. PATENT DOCUMENTS

2005/0206636 A1 9/2005 Kanai
2006/0164355 A1* 7/2006 Kim et al. ..... 345/89

(Continued)

FOREIGN PATENT DOCUMENTS

CN 1655015 A 12/2007
CN 101373583 A 2/2009

(Continued)

OTHER PUBLICATIONS

First Chinese Office Action Appln. No. 201310214107.1; Dated Apr. 13, 2015.

(Continued)

*Primary Examiner* — Andrew Sasinowski
*Assistant Examiner* — Kuo Woo
(74) *Attorney, Agent, or Firm* — Ladas & Parry LLP

(57) ABSTRACT

A Gamma curve adjustment method and a Gamma curve adjustment apparatus for a display apparatus. The method includes: obtaining correspondence relationship between current grayscale voltages and first transmittances of the display apparatus, the first transmittances being the transmittances of the display apparatus driving by the current grayscale voltages; determining a target grayscale voltage corresponding to each gray scale based on the correspon- (Continued)

dence relationship between the current grayscale voltages and the first transmittances and an ideal Gamma curve; generating and outputting the target grayscale voltage corresponding to each gray scale to the display apparatus; and obtaining an actual Gamma curve of the display apparatus driven by the target grayscale voltages as a final Gamma curve. The Gamma curve adjustment method improves the speed and efficiency of adjusting the Gamma curve.

8 Claims, 3 Drawing Sheets

(52) U.S. Cl.
CPC ..... *G09G 2310/027* (2013.01); *G09G 2320/0276* (2013.01); *G09G 2320/0673* (2013.01)

(58) Field of Classification Search
USPC ..... 345/88, 89, 102, 204, 690
See application file for complete search history.

(56) References Cited

U.S. PATENT DOCUMENTS

| | | | | |
|---|---|---|---|---|
| 2007/0103416 | A1 | 5/2007 | Kim | |
| 2012/0120124 | A1* | 5/2012 | Zhang | 345/690 |

FOREIGN PATENT DOCUMENTS

| | | | |
|---|---|---|---|
| CN | 101419783 | A | 4/2009 |
| CN | 102467862 | A | 5/2012 |
| CN | 103295506 | A | 9/2013 |

OTHER PUBLICATIONS

International Search Report Appln. No. PCT/CN2013-084301; Dated Feb. 11, 2014.
International Preliminary Report on Patentability issued Dec. 1, 2015; PCT/CN2013/084301.

* cited by examiner

GAMMA CURVE ADJUSTMENT METHOD AND GAMMA CURVE ADJUSTMENT APPARATUS

TECHNICAL FIELD OF THE DISCLOSURE

The present disclosure relates to the field of display technology, and particularly to a Gamma curve adjustment method and a Gamma curve adjustment apparatus for a display apparatus.

BACKGROUND

When a display device performs displaying, a nonlinear relationship is present between the input voltage applied to a pixel and the pixel brightness/transmittance. The curve reflecting such a nonlinear relationship is referred to as the Gamma curve.

The existing display device when being used all need to perform voltage conversion based on a preset Gamma characteristic curve. The difference between the Gamma value of the actual Gamma characteristic curve of the display apparatus and a target Gamma value (usually 2.2) determines the final display effect. The smaller the difference is, the better the display effect is.

Therefore, before display apparatuses are actually sold to customers/users, it is needed to perform some tests on the display apparatuses to obtain a Gamma curve whose Gamma value is as close to the target Gamma value as possible.

In the prior art, for a certain gray scale, an initial voltage is first output, and then the pixel brightness is tested to determine whether they have a power exponent relationship with a base of 2.2. If not, the initial voltage is adjusted and then the pixel brightness is tested to determine whether they have a power exponent relationship with a base of 2.2. The above procedure is repeated until the final voltage corresponding to the gray scale is found and a Gamma curve is created based on the brightness corresponding to the voltage.

It can be found that the above procedure for determining the Gamma curve is very cumbersome, and has low efficiency.

SUMMARY

The technical problem to be solved by the present disclosure is to provide a Gamma curve adjustment method and a Gama curve adjustment apparatus to improve the speed and efficiency of adjusting the Gamma curve of a display apparatus.

In order to solve the above technical problem, an embodiment of the present disclosure provides a Gamma curve adjustment method for a display apparatus, comprising:

obtaining correspondence relationship between current grayscale voltages and first transmittances of the display apparatus, the first transmittances being the transmittances of the display apparatus driven by the current grayscale voltages;

determining a target grayscale voltage corresponding to each gray scale based on the correspondence relationship between the current grayscale voltages and the first transmittances and an ideal Gamma curve;

generating and outputting the target grayscale voltage corresponding to each gray scale to the display apparatus; and obtaining an actual Gamma curve of the display apparatus driven by the target grayscale voltages as a final Gamma curve.

Optionally, in the above Gamma curve adjustment method, obtaining correspondence relationship between current grayscale voltages and first transmittances of the display apparatus can comprise:

determining the current grayscale voltage corresponding to each gray scale based on the original correspondence relationship between voltages and transmittances of the display apparatus;

generating and outputting the current grayscale voltage corresponding to each gray scale to the display apparatus;

testing the first transmittances of the display apparatus driven by the current grayscale voltages; and establishing the correspondence relationship between the current grayscale voltages and the first transmittances based on the first transmittances obtained by the testing.

Optionally, in the above Gamma curve adjustment method, determining a target grayscale voltage corresponding to each gray scale based on the correspondence relationship between the current grayscale voltages and the first transmittances and an ideal Gamma curve can comprise:

determining an ideal transmittance T corresponding to the gray scale of the target grayscale voltage to be determined currently based on the ideal Gamma curve;

selecting two adjacent transmittances T1 and T2 from the first transmittances, wherein T2>T>T1;

determining the current grayscale voltages V1 and V2 corresponding to T1 and T2 respectively; and determining the target grayscale voltage corresponding to the gray scale of the target grayscale voltage to be determined currently as (V2−V1)*(T−T1)/(T2−T1)+V1.

Optionally, in the above Gamma curve adjustment method, obtaining an actual Gamma curve of the display apparatus driven by the target grayscale voltages can comprise:

testing second transmittances of the display apparatus driven by the target grayscale voltages;

establishing correspondence relationship between the target grayscale voltages and the second transmittances based on the second transmittances obtained by the testing; and determining the actual Gamma curve describing correspondence relationship between gray scales and the second transmittances based on the correspondence relationship between the target grayscale voltages and the second transmittances and correspondence relationship between the target grayscale voltages and the gray scales.

In order to solve the above technical problem, an embodiment of the present disclosure provides a Gamma curve adjustment apparatus for a display apparatus, comprising:

a correspondence relationship obtaining module configured to obtain correspondence relationship between current grayscale voltages and first transmittances of the display apparatus, the first transmittances being the transmittances of the display apparatus driven by the current grayscale voltages;

a voltage determining module configured to determine a target grayscale voltage corresponding to each gray scale based on the correspondence relationship between the current grayscale voltages and the first transmittances and an ideal Gamma curve;

a driving module configured to generate and output the target grayscale voltage corresponding to each gray scale to the display apparatus; and a Gamma curve obtaining module configured to obtain an actual Gamma curve of the display apparatus driven by the target grayscale voltages as a final Gamma curve.

Optionally, in the above Gamma curve adjustment apparatus, the correspondence relationship obtaining module can comprise:

a first voltage determining unit configured to determine the current grayscale voltage corresponding to each gray scale based on the original correspondence relationship between voltages and transmittances of the display apparatus;

a driving unit configured to generate and output the current grayscale voltage corresponding to each gray scale to the display apparatus;

a first testing unit configured to test the first transmittances of the display apparatus driven by the current grayscale voltages; and a first correspondence relationship establishing unit configured to establish the correspondence relationship between the current grayscale voltages and the first transmittances based on the first transmittances obtained by the testing.

Optionally, in the above Gamma curve adjustment apparatus, the voltage determining module can comprise:

an ideal transmittance determining unit configured to determine an ideal transmittance T corresponding to the gray scale of the target grayscale voltage to be determined currently based on the ideal Gamma curve;

a selecting unit configured to select two adjacent transmittances T1 and T2 from the first transmittances, wherein T2>T>T1;

a second voltage determining unit configured to determine the current grayscale voltages V1 and V2 corresponding to T1 and T2 respectively; and a third voltage determining unit configured to determine the target grayscale voltage corresponding to the gray scale of the target grayscale voltage to be determined currently as (V2−V1)*(T−T1)/(T2−T1)+V1.

Optionally, in the above Gamma curve adjustment apparatus, the Gamma curve obtaining module can particularly comprise:

a second testing unit configured to test second transmittances of the display apparatus driven by the target grayscale voltages;

a second correspondence relationship establishing unit configured to establish correspondence relationship between the target grayscale voltages and the second transmittances based on the second transmittances obtained by the testing; and a Gamma curve determining unit configured to determine the actual Gamma curve describing correspondence relationship between gray scales and the second transmittances based on the correspondence relationship between the target grayscale voltages and the second transmittances and correspondence relationship between the target grayscale voltages and the gray scales.

The embodiments of the present disclosure can achieve the following benefits.

In the embodiments of the present disclosure, after correspondence relationship between a gray scale and a grayscale voltage is determined for the first time, the display apparatus is driven by the obtained current grayscale voltage to record an actual response of the display apparatus under the driving of the current grayscale voltage. Then, the target grayscale voltage corresponding to each gray scale is adjusted based on the actual response and the ideal Gamma curve, wherein the target grayscale voltage enables the final Gamma curve to be as close to the target as possible. Finally, the Gamma curve of the display apparatus is tested and obtained by using the adjusted target grayscale voltage. Therefore, in contrast to the try and error procedure of the prior art, the present disclosure reduces the time for determining the Gamma curve of the display apparatus dramatically, and thus improve the speed and efficiency.

DETAILED DESCRIPTION

In a Gamma curve adjustment method and a Gamma curve adjustment apparatus according to an embodiment of the present disclosure, after correspondence relationship between a gray scale and a voltage is determined for the first time, the display apparatus is driven by the obtained voltage to record an actual response of the display apparatus under the driving of the voltage. Then, the correspondence relationship between the gray scale and the voltage determined for the first time is adjusted based on the actual response and the ideal Gamma curve. Finally, the Gamma curve of the display apparatus is tested and obtained by using the adjusted correspondence relationship between the gray scale and the voltage, thereby improving the speed and efficiency of adjusting the Gamma curve of the display apparatus.

Figure 1:
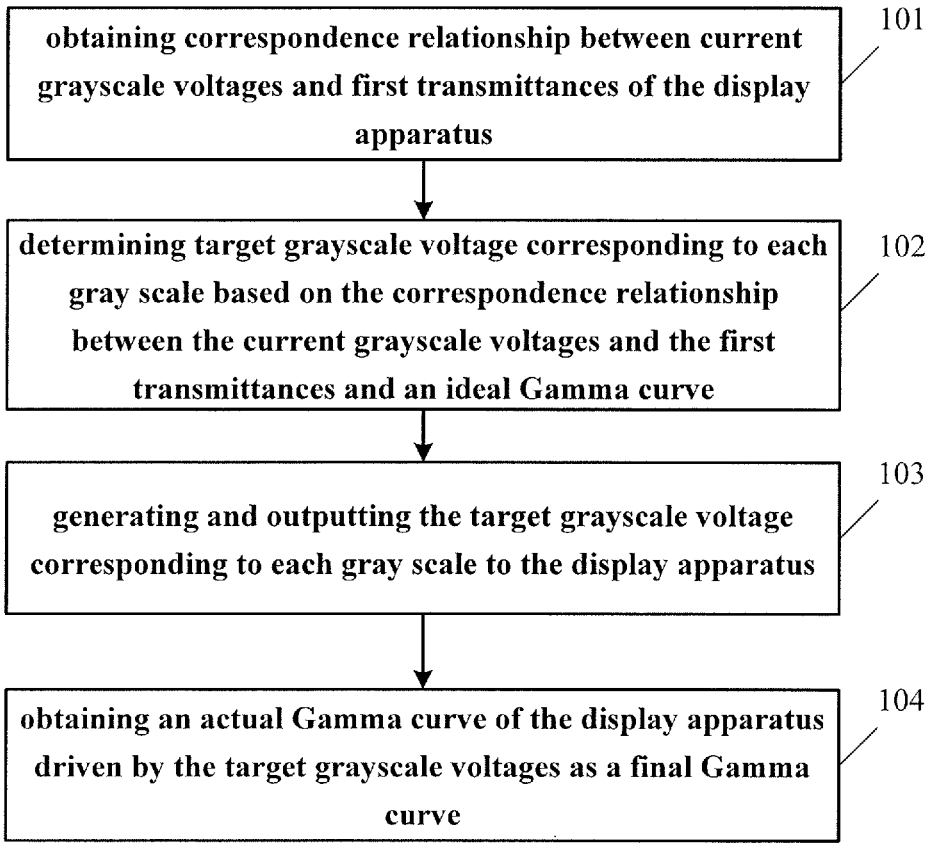
FIG. 1 is a schematic flowchart of a Gamma curve adjustment method for a display apparatus according to an embodiment of the present disclosure.

As shown in FIG. 1, an operation procedure of the Gamma curve adjustment method for a display apparatus according to an embodiment of the present disclosure is as follows:

in step 101, obtaining correspondence relationship between current grayscale voltages and first transmittances of the display apparatus, the first transmittances being the transmittances of the display apparatus driven by the current grayscale voltages;

in step 102, determining a target grayscale voltage corresponding to each gray scale based on the correspondence relationship between the current grayscale voltages and the first transmittances and an ideal Gamma curve;

in step 103, generating and outputting the target grayscale voltage corresponding to each gray scale to the display apparatus; and in step 104, obtaining an actual Gamma curve of the display apparatus driven by the target grayscale voltages as a final Gamma curve.

In the Gamma curve adjustment method according to the embodiment of the present disclosure, after correspondence relationship between a gray scale and a grayscale voltage is determined for the first time, the display apparatus is driven by the obtained current grayscale voltage to record an actual response of the display apparatus under the driving of the current grayscale voltage. Then, the target grayscale voltage corresponding to each gray scale is adjusted based on the actual response and the ideal Gamma curve, wherein the target grayscale voltage enables the final Gamma curve to be as close to the target as possible. Finally, the Gamma curve of the display apparatus is tested and obtained by using the adjusted target grayscale voltage. Therefore, in contrast to the try and error procedure of the prior art, the present disclosure reduces the time for determining the Gamma curve of the display apparatus dramatically, and thus improve the speed and efficiency.

The method according to the embodiment of the present disclosure is actually an adjustment procedure for the Gamma curve of the display apparatus to make the Gamma value of the final actual Gamma curve as close to the target value (usually 2.2) as possible. Furthermore, in contrast to the prior method, the embodiment of the present disclosure does not approximate the target value by trying one by one, but by the following two steps of: first determining the correspondence relationship between current actual gray scales and the grayscale voltages of the display apparatus; then adjusting the voltages based on the correspondence relationship between the current actual gray scales and the grayscale voltages and an ideal Gamma curve to make the Gamma curve further close to the target value under the driving of the target grayscales of the corresponding gray scales.

Therefore, the method according to the embodiment of the present disclosure is practically to determine directly the voltage corresponding to each gray scale based on the difference between the current state and the target state, whose the speed and efficiency is much more accurate than the manner of setting voltages based on experiences in the prior art, and the efficiency is also higher.

In an exemplary embodiment of the present disclosure, the correspondence relationship between the grayscale voltages and the transmittances need to be determined first. However, the accuracy of the grayscale voltages and the transmittances would influence the accuracy of the finally obtained Gamma curve.

Therefore, in an exemplary embodiment of the present disclosure, correspondence relationship between current grayscale voltages and first transmittances of the display apparatus is obtained by the following procedure which comprises:

determining the current grayscale voltage corresponding to each gray scale based on the original correspondence relationship between voltages and transmittances of the display apparatus;

generating and outputting the current grayscale voltage corresponding to each gray scale to the display apparatus;

testing the first transmittances of the display apparatus driven by the current grayscale voltages; and establishing the correspondence relationship between the current grayscale voltages and the first transmittances based on the first transmittances obtained by the testing.

In general, after a display apparatus is produced, there is an original correspondence relationship between its voltages and transmittances, but the original correspondence relationship may not be accurate. Now, considering the ideal Gamma curve, the current grayscale voltage corresponding to each gray scale under the original correspondence relationship between the voltages and the transmittances can be determined.

However, after the current grayscale voltages are determined, they can be used to drive the display apparatus to test the first transmittances of the display apparatus driven by the current grayscale voltages, and then establish the correspondence relationship between the current grayscale voltages and the first transmittances.

After the correspondence relationship between the current grayscale voltages and the first transmittances are built through the above procedure, the correspondence relationship may not be able to make the actual Gamma curve reach a preset target. Therefore, the embodiment of the present disclosure further performs adjustment by using an ideal Gamma curve to determine the target grayscale voltage corresponding to each gray scale.

After the current grayscale voltages and the first transmittances are determined, there are various ways to determine a Gamma curve as close to the ideal Gamma curve as possible in connection with the ideal Gamma curve. In the following, one exemplary embodiment among them is described as follows.

In an embodiment of the present disclosure, determining a target grayscale voltage corresponding to each gray scale based on the correspondence relationship between the current grayscale voltages and the first transmittances and an ideal Gamma curve can comprise:

determining an ideal transmittance T corresponding to the gray scale of the target grayscale voltage to be determined currently based on the ideal Gamma curve;

selecting two adjacent transmittances T1 and T2 from the first transmittances, wherein T2>T>T1;

determining the current grayscale voltages V1 and V2 corresponding to T1 and T2 respectively; and determining the target grayscale voltage corresponding to the gray scale of the target grayscale voltage to be determined currently as (V2−V1)*(T−T1)/(T2−T1)+V1.

The description is made below by taking the 8 bit display and 14 Gamma voltages as an example.

As shown in the following table 1, the correspondence relationship between the 14 Gamma voltages and the gray scales is as follows.

TABLE 1

| Gamma voltage | Gray scale |
|---|---|
| V1 | 255 |
| V2 | 223 |
| V3 | 191 |
| V4 | 127 |
| V5 | 63 |
| V6 | 15 |
| V7 | 0 |
| V8 | 0 |
| V9 | 15 |
| V10 | 63 |
| V11 | 127 |
| V12 | 191 |
| V13 | 223 |
| V14 | 255 |

How to compute the Gamma voltages corresponding to all gray scales by using the correspondence relationship between the above several gray scales and the Gamma voltage (grayscale voltage) specifically is well known to those skilled in the art, which is not described further here.

It is assumed that the testing results are as shown in the following table 2.

TABLE 2

| Gray Scale | Tested Transmittance | Ideal Transmittance |
|---|---|---|
| . . . | . . . | . . . |
| L219 | 70.15% | 71.55% |
| L220 | 70.76% | 72.27% |
| L221 | 71.53% | 72.99% |
| L222 | 72.24% | 73.72% |
| L223 | 73.17% | 74.45% |
| L224 | 73.86% | 75.19% |
| L225 | 74.68% | 75.93% |

TABLE 2-continued

| Gray Scale | Tested Transmittance | Ideal Transmittance |
|---|---|---|
| L226 | 75.46% | 76.67% |
| L227 | 76.00% | 77.42% |
| L228 | 76.63% | 78.18% |
| L229 | 77.28% | 78.93% |
| L230 | 78.02% | 79.69% |
| . . . | . . . | . . . |

Assuming that it is needed to determine the target grayscale voltages V2 and V3 corresponding to the gray scale of 223 at present, it can be found that the ideal transmittance for the gray scale of 223 is 74.45% by looking up the above table 2.

As can be found that 74.45% is located between adjacent tested transmittances of 73.86% (corresponding to the gray scale of 224) and 74.68% (corresponding to the gray scale of 225), while the gray scale of 224 is corresponding to two current grayscale voltages (symmetrically distributed relative to the voltage of the common electrode) which are assumed to be Vn and Vm, and the gray scale of 224 is corresponding to two current grayscale voltages (symmetrically distributed relative to the voltage of the common electrode) which are assumed to be Vi and Vj, wherein Vn and Vi are between V1 and V2, and Vm and Vj are between V13 and V14. Then, $$V2=(Vi-Vn)*(74.45-73.86)/(74.68-73\ 0.86)+Vn,$$

$$V13=(Vj-Vm)*(74.45\text{-}73.86)/(74.68-73.86)+Vm.$$

With the same approach, other 12 Gamma voltages can be obtained.

In an embodiment of the present disclosure, obtaining an actual Gamma curve of the display apparatus driven by the target grayscale voltages comprises:

testing second transmittances of the display apparatus driven by the target grayscale voltages;

establishing correspondence relationship between the target grayscale voltages and the second transmittances based on the second transmittances obtained by the testing; and determining the actual Gamma curve describing correspondence relationship between the gray scales and the second transmittances based on the correspondence relationship between the target grayscale voltages and the second transmittances and correspondence relationship between the target grayscale voltages and the gray scales.

Figure 2:
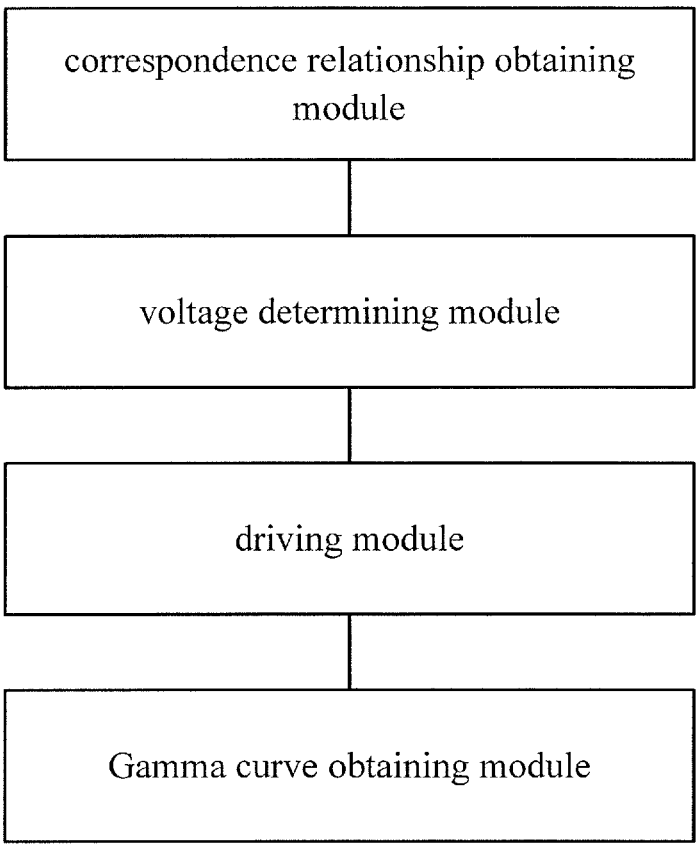
FIG. 2 is a schematic structural diagram of a Gamma curve adjustment apparatus for a display apparatus according to an embodiment of the present disclosure.

FIG. 2 illustrates a Gamma curve adjustment apparatus for a display apparatus according to an embodiment of the present disclosure. As shown in FIG. 2, the Gamma curve adjustment apparatus comprises:

a correspondence relationship obtaining module configured to obtain correspondence relationship between current grayscale voltages and first transmittances of the display apparatus, the first transmittances being the transmittances of the display apparatus driving by the current grayscale voltages;

a voltage determining module configured to determine the target grayscale voltage corresponding to each gray scale based on the correspondence relationship between the current grayscale voltages and the first transmittances and an ideal Gamma curve;

a driving module configured to generate and output the target grayscale voltage corresponding to each gray scale to the display apparatus; and a Gamma curve obtaining module configured to obtain an actual Gamma curve of the display apparatus driven by the target grayscale voltages as a final Gamma curve.

Optionally, the above correspondence relationship obtaining module can comprise:

a first voltage determining unit configured to determine the current grayscale voltage corresponding to each gray scale based on the original correspondence relationship between voltages and transmittances of the display apparatus;

a driving unit configured to generate and output the current grayscale voltage corresponding to each gray scale to the display apparatus;

a first testing unit configured to test the first transmittances of the display apparatus driven by the current grayscale voltages; and a first correspondence relationship establishing unit configured to establish the correspondence relationship between the current grayscale voltages and the first transmittances based on the first transmittances obtained by the testing.

Optionally, in the above Gamma curve adjustment apparatus, the voltage determining module can comprise:

an ideal transmittance determining unit configured to determine an ideal transmittance T corresponding to the gray scale of the target grayscale voltage to be determined currently based on the ideal Gamma curve;

a selecting unit configured to select two adjacent transmittances T1 and T2 from the first transmittances, wherein T2>T>T1;

a second voltage determining unit configured to determine the current grayscale voltages V1 and V2 corresponding to T1 and T2 respectively; and a third voltage determining unit configured to determine the target grayscale voltage corresponding to the gray scale of the target grayscale voltage to be determined currently as (V2−V1)*(T−T1)/(T2−T1)+V1.

Optionally, in the above Gamma curve adjustment apparatus, the Gamma curve obtaining module can comprise:

a second testing unit configured to test second transmittances of the display apparatus driven by the target grayscale voltages;

a second correspondence relationship establishing unit configured to establish correspondence relationship between the target grayscale voltages and the second transmittances based on the second transmittances obtained by the testing; and a Gamma curve determining unit configured to determine the actual Gamma curve describing correspondence relationship between gray scales and the second transmittances based on the correspondence relationship between the target grayscale voltages and the second transmittances and correspondence relationship between the target grayscale voltages and the gray scales.

A specific application of an embodiment of the present disclosure will be described below.

Figure 3:
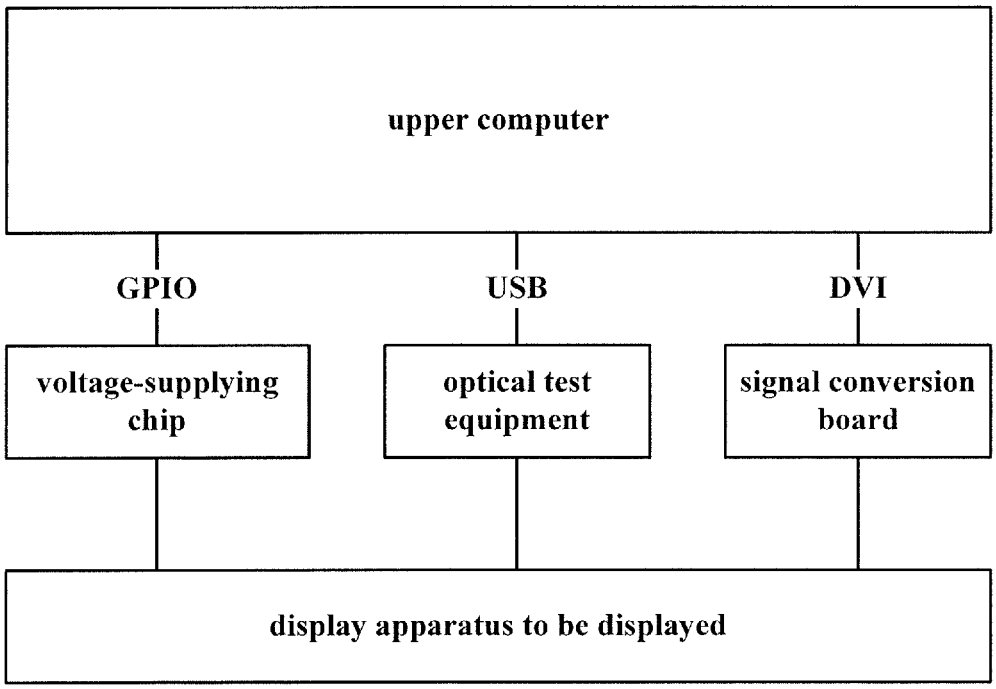
FIG. 3 is a schematic diagram for a practical application architecture of a display apparatus according to an embodiment of the present disclosure.

As shown in FIG. 3, in the specific application procedure, the Gamma curve adjustment apparatus of an embodiment of the present disclosure can comprise the following parts: an upper computer, a voltage-supplying chip, an optical test equipment, and a signal conversion board.

The upper computer is used for various computations and controls, the voltage-supplying chip generates required voltage and outputs the same to the display apparatus to be tested to drive the display apparatus to be tested under the control of the upper computer, the optical text equipment measures the transmittances of the display apparatus to be tested under the control of the upper computer, and the signal conversion board lights the display apparatus to be tested under the control of the upper computer.

However, the upper computer can be connected to the voltage-supplying chip, the optical test equipment and the signal conversion board by for example (but not limited to) a GPIO interface, a USB interface and a DVI interface.

Next, the operation procedure is described in detail as follows.

The upper computer first computes a current grayscale voltage (a first version of voltage) corresponding to each gray scale based on an ideal Gamma curve with the Gamma value of 2.2 after obtaining the original V-T curve of the display apparatus to be tested.

Then, after the upper computer controls the signal conversion board to light the display apparatus to be tested, the upper computer controls the voltage-supplying chip to generate and output the current grayscale voltage corresponding to each gray scale to the display apparatus to be tested.

The display apparatus to be tested operates under the driving of the current gray voltage and the signal conversion board together.

Then, the upper computer controls the test equipment to measure the intensity of light from the display apparatus to be tested to obtain the transmittance corresponding to the current grayscale voltage after calculating the transmittance based on the intensity of light.

After the upper computer obtains the relationship between the current grayscale voltage and the transmittance, the upper computer determines a target grayscale voltage (a second version of voltage) close to the ideal Gamma curve in connection with the ideal Gamma curve. The procedure has been described in detail in the above, and will not be repeated here.

The upper computer controls the voltage-supplying chip again to generate and output a target grayscale voltage corresponding to each gray scale to the display apparatus to be tested. The upper computer controls the test equipment to measure the intensity of light from the display apparatus to be tested to obtain the transmittance corresponding to the current grayscale voltage after calculating the transmittance based on the intensity of light.

Last, the final Gamma curve corresponding to the second version of voltages is obtained based on the transmittances corresponding to the target grayscale voltages obtained by the testing to complete the Gamma adjustment.

The above description is exemplary embodiments of the present disclosure. It is noted that it is possible for those skilled in the art to make several improvements and modifications which are regarded as being within the protection scope of the present disclosure without departing from the principles of the present disclosure.

What is claimed is:

1. A Gamma curve adjustment method for a display apparatus, comprising:

obtaining correspondence relationship between current grayscale voltages and first transmittances of the display apparatus, the first transmittances being the transmittances of the display apparatus driven by the current grayscale voltages; wherein obtaining correspondence relationship between current grayscale voltages and first transmittances of the display apparatus comprises: determining the current grayscale voltage corresponding to each gray scale based on the original correspondence relationship between voltages and transmittances of the display apparatus and an ideal Gamma curve; generating and outputting the current grayscale voltage corresponding to each gray scale to the display apparatus; testing the first transmittances of the display apparatus driven by the current grayscale voltages; and establishing the correspondence relationship between the current grayscale voltages and the first transmittances based on the first transmittances obtained by the testing;

determining a target grayscale voltage corresponding to each gray scale based on the correspondence relationship between the current grayscale voltages and the first transmittances and the ideal Gamma curve, wherein an ideal transmittance T corresponding to the gray scale of the target grayscale voltage to be determined currently is determined based on the ideal Gamma curve, and two adjacent transmittances T1 and T2 are selected from the first transmittances, wherein T2>T>T1, and the target grayscale voltage corresponding to the ideal transmittance T is determined from the current grayscale voltages V1 and V2 corresponding to T1 and T2 respectively, based on a linear relationship;

generating and outputting the target grayscale voltage corresponding to each gray scale to the display apparatus; and obtaining an actual Gamma curve of the display apparatus driven by the target grayscale voltages as a final Gamma curve.

2. The Gamma curve adjustment method according to claim 1, wherein the linear relationship is as follows:

$$(V2-V1)*(T-T1)/(T2-T1)+V1.$$

3. The Gamma curve adjustment method according to claim 1, wherein obtaining an actual Gamma curve of the display apparatus driven by the target grayscale voltages comprises:

testing second transmittances of the display apparatus driven by the target grayscale voltages;

establishing correspondence relationship between the target grayscale voltages and the second transmittances based on the second transmittances obtained by the testing; and determining the actual Gamma curve describing correspondence relationship between gray scales and the second transmittances based on the correspondence relationship between the target grayscale voltages and the second transmittances and correspondence relationship between the target grayscale voltages and the gray scales.

4. The Gamma curve adjustment method according to claim 2, wherein obtaining an actual Gamma curve of the display apparatus driven by the target grayscale voltages comprises:

testing second transmittances of the display apparatus driven by the target grayscale voltages;

establishing correspondence relationship between the target grayscale voltages and the second transmittances based on the second transmittances obtained by the testing; and determining the actual Gamma curve describing correspondence relationship between gray scales and the second transmittances based on the correspondence relationship between the target grayscale voltages and the second transmittances and correspondence relationship between the target grayscale voltages and the gray scales.

5. A Gamma curve adjustment apparatus for a display apparatus, comprising:

an upper computer configured to obtain correspondence relationship between current grayscale voltages and first transmittances of the display apparatus, the first transmittances being the transmittances of the display apparatus driven by the current grayscale voltages; wherein the upper computer is configured to determine the current grayscale voltage corresponding to each gray scale based on the original correspondence relationship between voltages and transmittances of the display apparatus and an ideal Gamma curve;

a voltage supplying chip configured to generate and output the current grayscale voltage corresponding to each gray scale to the display apparatus;

an optical test equipment configured to test the first transmittances of the display apparatus driven by the current grayscale voltages;

wherein the upper computer is further configured to establish the correspondence relationship between the current grayscale voltages and the first transmittances based on the first transmittances obtained by the optical test equipment, and to determine a target grayscale voltage corresponding to each gray scale based on the correspondence relationship between the current grayscale voltages and the first transmittances and the ideal Gamma curve;

the voltage supplying chip is further configured to generate and output the target grayscale voltage corresponding to each gray scale to the display apparatus; and the upper computer is configured to obtain an actual Gamma curve of the display apparatus driven by the target grayscale voltages as a final Gamma curve;

wherein the upper computer is configured to determine an ideal transmittance T corresponding to the gray scale of the target grayscale voltage to be determined currently based on the ideal Gamma curve;

select two adjacent transmittances T1 and T2 from the first transmittances, wherein T2>T>T1;

determine the current grayscale voltages V1 and V2 corresponding to T1 and T2 respectively; and determine the target grayscale voltage corresponding to the ideal transmittance T from the current grayscale voltages V1 and V2, corresponding to T1 and T2 respectively, based on a linear relationship.

6. The Gamma curve adjustment apparatus according to claim 5, wherein the linear relationship is as follows:

$$(V2-V1)*(T-T1)/(T2-T1)+V1.$$

7. The Gamma curve adjustment apparatus according to claim 5, wherein the optical test equipment is further configured to test second transmittances of the display apparatus driven by the target grayscale voltages;

the upper computer is configured to establish correspondence relationship between the target grayscale voltages and the second transmittances based on the second transmittances obtained by the optical test equipment; and determine the actual Gamma curve describing correspondence relationship between gray scales and the second transmittances based on the correspondence relationship between the target grayscale voltages and the second transmittances and correspondence relationship between the target grayscale voltages and the gray scales.

8. The Gamma curve adjustment apparatus according to claim 6, wherein the optical test equipment is configured to test second transmittances of the display apparatus driven by the target grayscale voltages;

the upper computer is configured to establish correspondence relationship between the target grayscale voltages and the second transmittances based on the second transmittances obtained by the optical test equipment; and determine the actual Gamma curve describing correspondence relationship between gray scales and the second transmittances based on the correspondence relationship between the target grayscale voltages and the second transmittances and correspondence relationship between the target grayscale voltages and the gray scales.

* * * * *